US007018119B2

(12) United States Patent
Koyabu

(10) Patent No.: US 7,018,119 B2
(45) Date of Patent: Mar. 28, 2006

(54) ROLLED PAPER HOLDER AND IMAGE FORMING APPARATUS INCORPORATING THE SAME

(75) Inventor: Akira Koyabu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/849,563

(22) Filed: May 20, 2004

(65) Prior Publication Data

US 2005/0002721 A1 Jan. 6, 2005

(30) Foreign Application Priority Data

May 21, 2003 (JP) ..... P2003-143425

(51) Int. Cl.
*B65H 75/00* (2006.01)

(52) U.S. Cl. ..... 400/242; 400/243; 242/563; 242/596; 242/597.5

(58) Field of Classification Search ..... 400/242, 400/703, 243; 242/563, 596, 597.5
See application file for complete search history.

(56) References Cited

U.S. PATENT DOCUMENTS 5,432,687 A * 7/1995 Lane ..... 362/99
5,813,343 A * 9/1998 Harb ..... 101/407.1
5,820,068 A 10/1998 Hosomi et al.
5,833,380 A 11/1998 Hosomi et al.
5,884,861 A 3/1999 Hosomi et al.
6,118,469 A 9/2000 Hosomi
6,536,696 B1 * 3/2003 Fiutak et al. ..... 242/358.1
6,629,666 B1 * 10/2003 Lee et al. ..... 242/563
6,796,234 B1 * 9/2004 Busshoff ..... 101/389.1

FOREIGN PATENT DOCUMENTS

| | | |
|---|---|---|
| EP | 1 093 928 | 4/2001 |
| JP | 58-116184 | 7/1983 |
| JP | 9-295436 | 11/1997 |
| JP | 2000-44099 | 2/2000 |

* cited by examiner

*Primary Examiner*—Andrew H. Hirshfeld
*Assistant Examiner*—Dave A. Ghatt
(74) *Attorney, Agent, or Firm*—Nixon & Vanderhye P.C.

(57) ABSTRACT

In a holder for holding a rolled recording medium, each of a pair of side wall members is opposed to a side end face of the rolled recording medium to regulate a position of the rolled recording medium in a widthwise direction thereof. At least one of the side wall members includes a first section adapted to be brought into contact with the side end face, and a second section adapted to avoid contact with the side end face. A position of the second section is determined such that an upper part of the side end face is free from contact with the at least one of the side wall members, and a position of the first section is determined such that a lower part of the side end face is brought into contact with the first section.

14 Claims, 16 Drawing Sheets

ROLLED PAPER HOLDER AND IMAGE FORMING APPARATUS INCORPORATING THE SAME

BACKGROUND OF THE INVENTION

The present invention relates to a rolled paper holder and a printer incorporating the same.

A printer is known for forming images (including "character printing") on a recording medium such as paper (hereinafter, referred as "recording paper"), using rolled paper as the recording paper. The rolled paper is advantageous in that it enables a continuous supply of the recording paper for a long time period.

In the printer of this type, there are a shaft-supporting type and a throw-in type in connection with the structure of a paper feeding section for holding the rolled recording paper. In comparison with the shaft-supporting type, which employs such structure that the supporting shaft is inserted into the core hole of the rolled paper, the throw-in type is very convenient since the operation for setting the rolled recording paper is simply to put the rolled recording paper into a paper storage space.

A first example of a related-art throw-in type printer 80 (line thermal printer) will be described below with reference to FIGS. 9 through 13. Incidentally, the overall structure (e.g., a casing body) of the printer 80 will not be shown.

As shown in FIG. 9, the thermal printer 80 comprises a rolled paper holder 71, a thermal recording head 20 disposed on one side (front side of the printer) of a paper storage space 72, and a platen roller 30.

The rolled paper holder 71 includes a curved bottom face 71*f* for supporting the rolled paper 10 from the lower side, and a right guide face 71*d* and a left guide face 71*g* upright from the bottom face 71*f*. A recess 71*k* is formed at a center part of the bottom face 71*f* for holding the rolled paper 10 irrespective of the remaining amount thereof.

The right guide face 71*d* and the left guide face 71*g* are configured to face a right end face 10*b* and a left end face 10*c* of the rolled paper 10 respectively. The distance between the right guide face 71*d* and the left guide face 71*g* is determined to be slightly larger than the width of the rolled paper 10. Therefore, paper 11 drawn out from the outer most periphery of the rolled paper 10 is guided to a recording section including the platen roller 30 and the thermal recording head 20 while being regulated in position at both edges thereof by the right guide face 71*d* and the left guide face 71*g*.

The platen roller 30 is rotatably disposed in parallel with the axial core of the rolled paper 10. The thermal recording head 20 is disposed in parallel to and opposed to the platen roller 30. The thermal recording head 20 is pivotably supported by supporting shafts 20*a*, 20*b* provided in parallel with the axial core of the platen roller 30. The thermal recording head 20 is urged by a not-shown resilient member so that the recording face thereof is pressed against the platen roller 30 in the direction indicated by an arrow F1 in FIG. 9.

The rolled portion of the rolled paper 10 is held in the paper storage space 72, and the paper 11 drawn out from the outermost periphery thereof is clamped between the platen roller 30 and the thermal recording head 20. The paper 11 is thus transported in a predetermined direction (the direction indicated by an arrow Y) by the rotation of the platen roller 30 when a not-shown driving source such as a motor is activated.

The printer 80 may be provided with a near-end detector 40 for detecting that the remaining amount of the rolled paper 10 is coming to an end.

The near-end detector 40 includes a frame 44, a contact 41, a spring 43, and a switch 42. The contact 41 is pivotably supported by a supporting member 44*a* of the frame 44, and the extremity 41*a* of the contact 41 is pressed by resiliency of the spring 43 so as to come into contact with the left end face 10*c* of the rolled paper 10.

The switch 42 is operated in accordance with the pivotal position of the contact 41. The switch 42 is set to operate in such a manner that the height of the center of the rolled paper 10 is lowered as the rolled paper 10 is being consumed, and when the remaining amount is below a predetermined amount, the extremity 41*a* of the contact enters the rolled paper core hole 10*a* by a force of the spring 43 in the direction indicated by an arrow G and a phantom line shown in FIG. 10. During this operation, the contact 41 is pivoted and activates the switch 42. The near-end state that the remaining amount of the rolled paper is below the predetermined amount is detected by the switch 42.

In such a printer 80, slight variations in parallelism exist between the bottom face 71*f* of the rolled paper holder 71 and the platen roller 30, and variations occur in the outer diameter of the platen roller 30. When the paper 11 is drawn out from the rolled paper 10, the amount of paper feeding on the left and the right in the widthwise direction of the paper 11 differs from each other due to such variations. As a result, a component force is generated in the direction of the width of the paper, so that the paper 11 shifts in the direction of the width at the portion of the outermost periphery of the rolled paper 10 as shown in FIG. 11.

In such a case, the paper 11 travels in a state where the left end face 10*c* of the rolled paper 10 is in contact with the left guide face 71*g*. Therefore, the right end face 10*b* of the rolled paper 10 is brought into contact with the right guide face 71*d* on the other side by the reaction force. In addition, when the rolled paper 10 is consumed and the weight is reduced, the influence of the frictional force due to the contact between the right end face 10*b* of the rolled paper 10 and the right guide face 71*d* increases. Further, when the frictional force is generated in the hatched section A shown in FIG. 12, the entire rolled paper 10 is lifted by the force B drawing out the paper 11.

Specifically, a moment works as a rotational force to lift the rolled paper 10 in the direction indicated by an arrow C about the position of the hatched area A as a rotation center (here, the rotation radius is represented by L5). Accordingly, the rolled paper 10 is lifted from the bottom face 71*f*, so that the holding state of the rolled paper 10 becomes unstable. Further, the edges of the paper 11 are strongly brought into contact with the side guide faces 71*d*, 71*g* of the rolled paper holder 71. As a result, the paper 11 cannot be accurately fed (skewed travel is occurred), and the edges of the paper 11 are bent. Further, erroneous detection of the near-end detector 40 would occur and noise is generated when the lifted rolled paper 10 returns to the original position thereof and collides with the bottom face 71*f*.

As noted, a pressing force of the spring 43 always acts on the contact 41. Therefore, the right end face 10*b* of the rolled paper 10 is strongly brought into contact with the right guide face 71*d* in comparison with the case in which the near-end detector 40 is not provided. In other words, frictional force generated in the hatched area A increases, thereby increasing the possibility of the above lifting phenomenon.

A problem arises in that while at least a certain level of spring load is required for the spring 43 in order to secure the accuracy of the near-end detector 40, a smaller spring load is advantageous for preventing the lifting phenomenon of the rolled paper 10, and it was very difficult to achieve a setting which satisfies both conditions.

As shown in FIG. 13, there is a case where the extremity 41*a* of the contact 41 enters the space between the rolled paper 10 and the bottom face 71*f* when the rolled paper 10 is lifted.

In such a situation, the near-end detector 40 is activated before the paper reaches the predetermined remaining amount. In addition, it may cause skewed travel of the paper 11 because the rolled paper 10 is obliquely held in the paper storage space 72. Consequently, problems such as misalignment of printing position and bending of the paper edge may occur.

The width of the rolled paper 10 varies from one another due to manufacturing error or the like. Therefore, the storage space 72 width between the left and right guide faces 71*d*, 71*g* is set to accommodate the largest possible width of the rolled paper 10. For example, when the smallest possible width of the rolled paper 10 is accommodated in the storage space 72, the rolled paper 10 moves in the widthwise direction thereof due to gaps formed between the side end faces 10*b*, 10*c* and the guide faces 71*d*, 71*g*. As a result, the positional control of the paper 11 cannot be stabilized, so that deviations of the printing position in the widthwise direction of the paper 11 are generated.

In order to solve this problem, there is a printer in which one of the side guide faces of the rolled paper holder 71 is fixed as a reference side, while the other is provided with a guide member movable in the widthwise direction of the rolled paper 10. However, the movable guide member has to be always brought into contact with the side end face of the rolled paper 10 by the resilient force of a spring member or the like in order to press it against the fixed side guide face of the rolled paper holder 71. To attain stable contact between the rolled paper 10 and the fixed side end face, the resilient force has to be stronger than a certain level. As a result, the possibility of the problems such as the above-described lifting phenomenon is increased.

A second example of a related-art printer 90 will be described with reference to FIGS. 14 through 16. The members similar to those in the first related-art printer 80 will be designated by the same reference numerals, and the repetitive explanation for those will be omitted.

The printer 90 is different from the printer 80 in structure of a rolled paper holder. Specifically, as shown in FIG. 14, a rolled paper holder 91 is configured with the distance L1 between front end portions 91*d*, 91*g* of a right guide face and a left guide face adapted to have the same dimension corresponding to the rolled paper 10 in substantially the same manner as in the first related-art printer 80. However, the distance L2 between rear end portions 91*e*, 91*h* of the right guide face and the left guide face is adapted to be relatively large with respect to the rolled paper 10. In other words, the distance between the left and right guide faces of the rolled paper holder 91 gradually increases from the front side to the rear side of the printer 90 (from the right side to the left side of FIG. 14).

On the other hand, as shown in FIG. 15, the distance L4 between upper end portions of the guide faces of the rolled paper holder 91 is larger than the distance L3 between lower end portions of the guide faces.

With this arrangement, only the portions of the guide faces that are closer to the front end and a bottom face 91*f* of the rolled paper holder 91 (i.e., the hatched portion Z in FIG. 16) are brought into contact with the side end faces 10*b*, 10*c* of the rolled paper 10. Hence, the portion where the frictional forces are generated between the guide faces of the rolled paper holder 91 and the side faces of the rolled paper 10 opposes the lower part of the rolled paper 10, thereby suppressing the occurrence of the lifting phenomenon. However, the holding stability with respect to the rolled paper 10 lowers at the rear end portions and the upper end portions of the guide faces of the rolled guide holder 91 (i.e., the portions where the distances therebetween are enlarged). Specifically, there is a problem that the amount of inclination of the rolled paper 10 in the widthwise direction thereof increases when the rolled paper 10 having an outer diameter (thickness) relatively larger than the width thereof is initially used. Therefore, the rolled recording paper cannot be held stably.

It is preferable that the position of installation of one single printer is not limited to the horizontal face, but may be selected from a plurality of choices such as the slope face or the vertical wall face in order to increase flexibility of conditions of installation (the place of installation).

The rolled paper 10 can be stably held when the printer 90 is installed on the horizontal face because the distances between the front end portions and the rear end portions of the guide faces of the rolled paper holder 91 are substantially coincident with the width of the rolled paper 10. However, if the printer 90 is installed at such a position that the rolled paper 10 is placed at the rear part of the rolled paper holder 91, stable holding cannot be attained.

Structures similar to the related-art printers are disclosed in Japanese Patent Publication No. 2000-44099A, for example.

SUMMARY OF THE INVENTION

It is therefore an object of the invention to provide a throw-in type rolled paper holder which is capable of preventing the rolled paper from lifting, capable of holding the rolled paper stably to thereby prevent noises from being generated, capable of preventing malfunction of the near-end detector from occurring, and capable of preventing the drawn-out paper from being skewed and bent.

It is also an object of the invention to provide a throw-in type rolled paper holder capable of stably holding the rolled paper irrespective of the installation attitude of a printer.

It is also an object of the invention to provide a printer incorporating such a rolled paper holder.

In order to achieve the above objects, according to the invention, there is provided a holder for holding a rolled recording medium, comprising:

a pair of side wall members, each of which is opposed to a side end face of the rolled recording medium to regulate a position of the rolled recording medium in a widthwise direction thereof, at least one of the side wall members including a first section adapted to be brought into contact with the side end face, and a second section adapted to avoid contact with the side end face, wherein a position of the second section is determined such that an upper part of the side end face is free from contact with the at least one of the side wall members, and wherein a position of the first section is determined such that a lower part of the side end face is brought into contact with the first section.

Preferably, the second section is a recess formed on the at least one of the side wall members.

Preferably, the holder further comprises a bottom wall member connecting the side wall members and formed with at least one recess for holding the rolled recording medium at a predetermined position.

Here, it is preferable that the at least one recess includes a first recess for holding the rolled recording medium at a first predetermined position when the holder is horizontally installed, and a second recess for holding the recording medium at a second predetermined position when the holder is vertically installed.

Preferably, the holder further comprises a detector provided on one of the side wall members, the detector comprising a contact member abutted against one of the side end faces of the rolled recording medium such that a contact condition is changed when a diameter of the rolled recording medium becomes a predetermined value or less. Here, the first section and the second section are provided on the other of the side wall members.

Preferably, one of the side wall members is movable in the widthwise direction of the rolled recording medium so as to resiliently press the rolled recording medium against the other of the side wall members.

According to the invention, there is also provided an image forming apparatus comprising an image forming section, which performs an image forming operation with respect to a recording medium drawn out from the rolled recording member held in the above holder.

According to the invention, there is also provided a recording medium holder for holding a rolled recording medium, where the recording medium holder comprises a pair of sidewalls sufficiently spaced to receive the rolled recording medium, with at least one of the sidewalls including a recessed portion therein defining a non-contact area. At least one sidewall is structured such that when a size of the rolled recording medium is below a predetermined diameter, a portion of the rolled recording medium is disposed adjacent the recessed non-contact area.

Also according to the invention, there is provided a paper holder for holding a paper roll, the paper holder comprising:

a bottom wall member shaped to support the paper roll, and a pair of sidewalls extending upward from the bottom wall member, the sidewalls being sufficiently spaced to receive the paper roll, wherein at least one of the sidewalls comprises structure for avoiding contact with a side end face of the paper roll regardless of an orientation of the paper holder and depending on a size of the paper roll.

A printer including a print head and a platen roller disposed adjacent the print head and incorporating the paper holder of the invention is also provided.

With the above configurations, the rolled recording medium held in the holder can be rotated with less force, so that the recording medium subjected to the image forming operation can be drawn out from the rolled recording medium smoothly and stably. Further, since the distance between the side wall members are suitably determined relative to the width of the rolled recording member, loading the rolled recording medium is easy, and noises due to the play of the rolled recording medium can be prevented by gaps between the rolled recording medium and the side wall members. Further, skewed travel and edge bending of the recording medium can be avoided.

In addition, since the contact load of the contact member of the detector is allowed to be increased, the design flexibility of the detector and the holding stability with respect to the rolled recording medium can be increased.

Furthermore, the above advantages can be obtained irrespective of the installation attitude of the holder. There can be provided an image forming apparatus adapted for various installation requirements.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
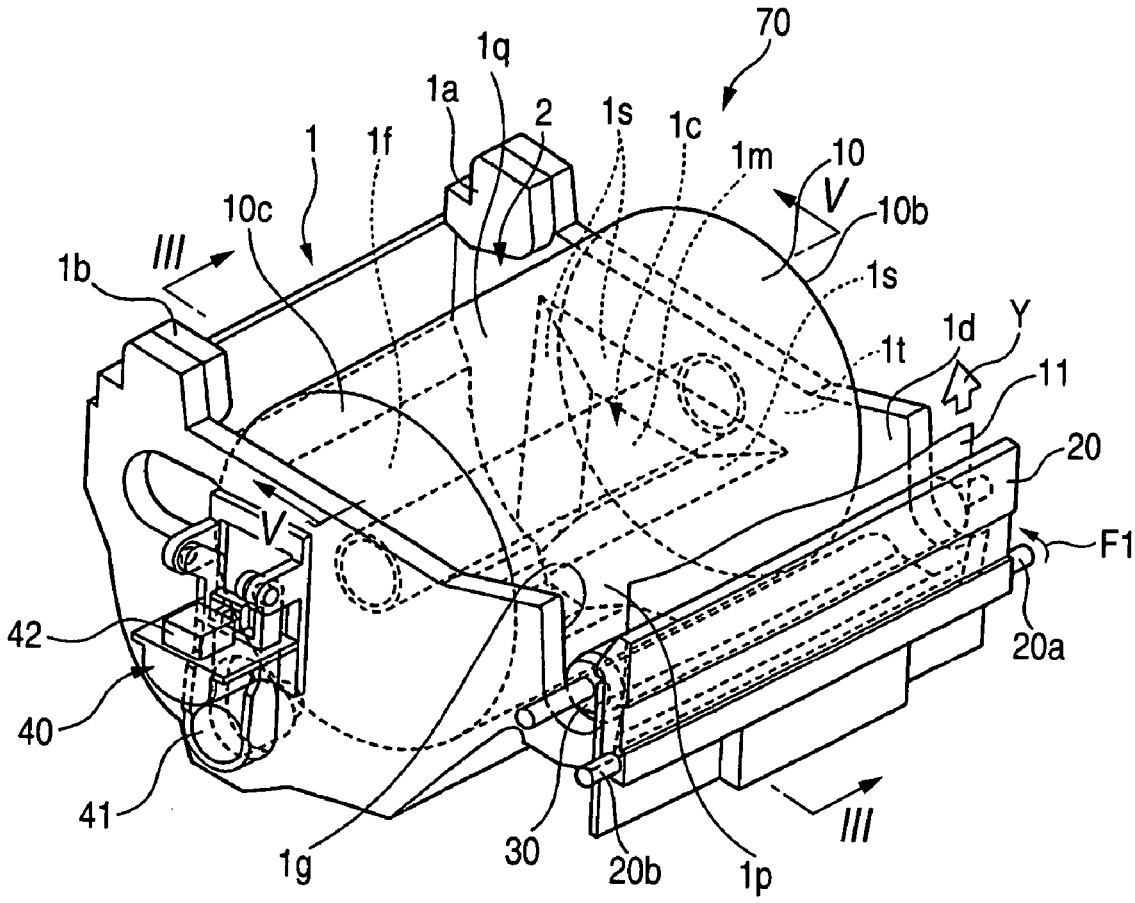
FIG. 1 is a perspective view of a portion of a printer according to a first embodiment of the invention.

Preferred embodiments of the invention will be described below in detail with reference to the accompanying drawings.

A line thermal printer 70 (hereinafter, simply referred as "printer") which is a first embodiment of the invention will be described with reference to FIGS. 1 through 6.

FIG. 1 to FIG. 6 are drawings showing a first embodiment of the present invention. The members similar to those in the first related-art printer 80 will be designated by the same reference numerals, and the repetitive explanation for those will be omitted.

As shown in FIG. 1, the printer 70 comprises a rolled paper holder 1, a thermal recording head 20 disposed on one side (front side of the printer) of a paper storage space 2 of the rolled paper holder 1, a platen roller 30, and a near-end detector 40 for detecting that the remaining amount of the rolled paper 10 is coming to an end.

The rolled paper holder 1 includes a curved bottom face 1*f* for supporting the rolled paper 10 from the lower side, and a right guide face 1*d* and a left guide face 1*g* upright from the bottom face 1*f*. A recess 1*k* is formed at a center part of the bottom face 1*f* for holding the rolled paper 10 irrespective of the remaining amount thereof (see FIGS. 3 and 4).

The right guide face 1*d* and the left guide face 1*g* are configured to face a right end face 10*b* and the left end face 10*c* of the rolled paper 10 respectively. The distance between the right guide face 1*d* and the left guide face 1*g* is determined to be slightly larger than the width of the rolled paper 10. Therefore, paper 11 drawn out from the outer most periphery of the rolled paper 10 is guided to a recording section including the platen roller 30 and the thermal recording head 20 while being regulated in position at both edges thereof by the right guide face 1*d* and the left guide face 1*g*.

Figure 2:
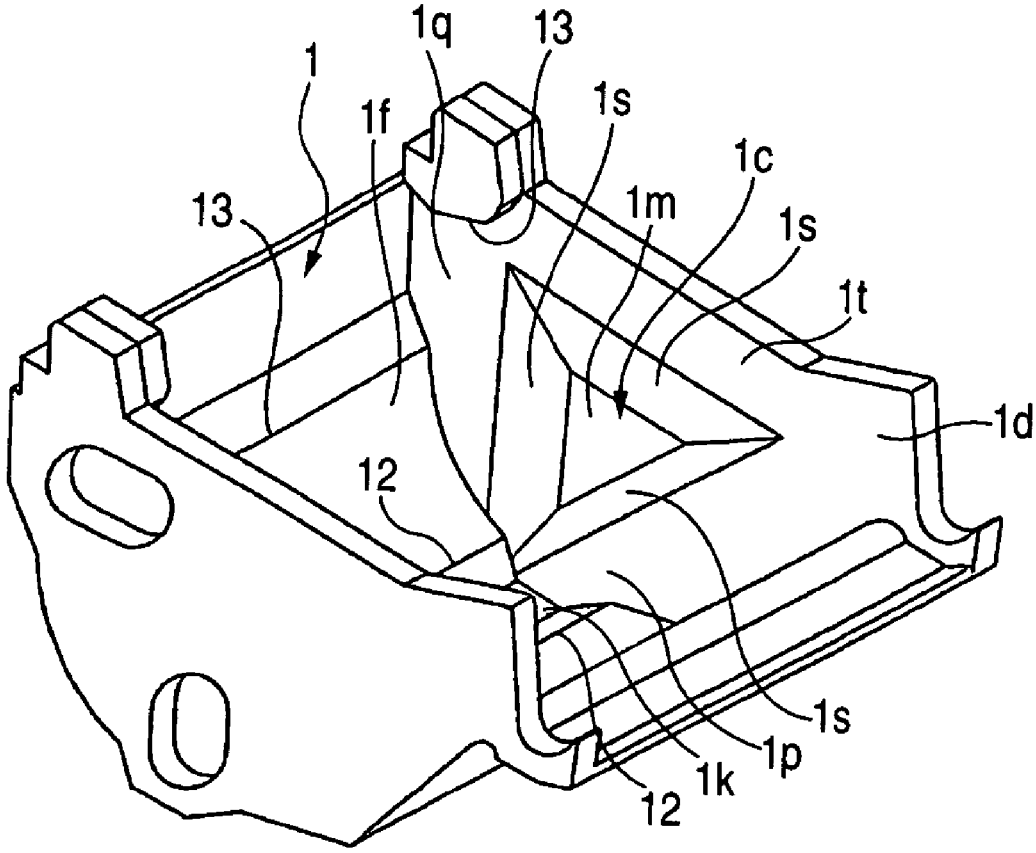
FIG. 2 is a perspective view of a rolled paper holder in the printer of FIG. 1.

In this embodiment, as shown in FIG. 2, the right guide face 1*d* is formed with a recess 1*c* at a substantially central portion thereof. The recess 1*c* has a truncated triangular pyramid shape in which a central bottom part 1*m* is continued from the right guide face 1*d* via gentle slopes 1*s*. Due to the existence of the recess 1*c*, at least a part of the upper part of the rolled paper 10 (i.e., the part above the core hole 10*a*) is always free from contact with the right guide face 1*d*. On the other hand, the lower part (i.e., the part below the core hole 10*a*) is always brought into contact with a guiding portion 1*p* of the right guide face 1*d* irrespective of the diameter of the rolled paper 10 (see FIGS. 3 and 4).

Figure 3:
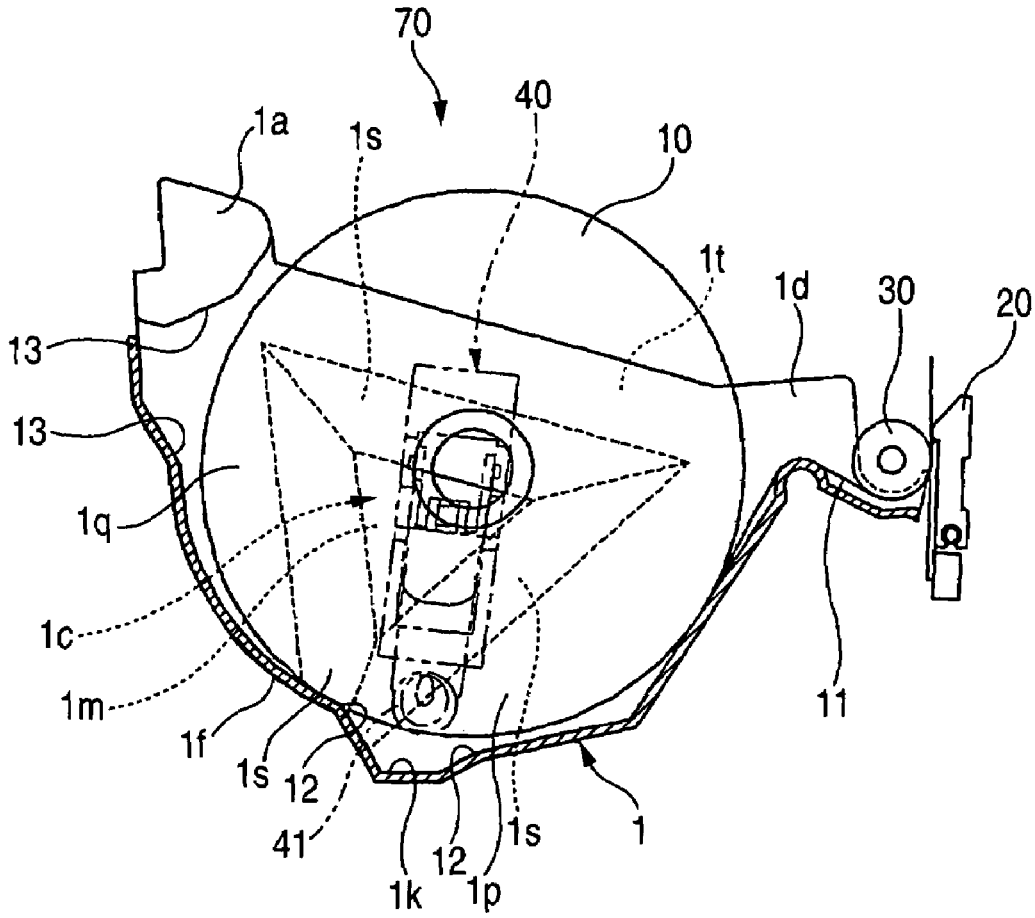
FIG. 3 is a section view taken along a line III—III in FIG. 1, showing a state that the remaining amount of the rolled paper is large.
Figure 4:
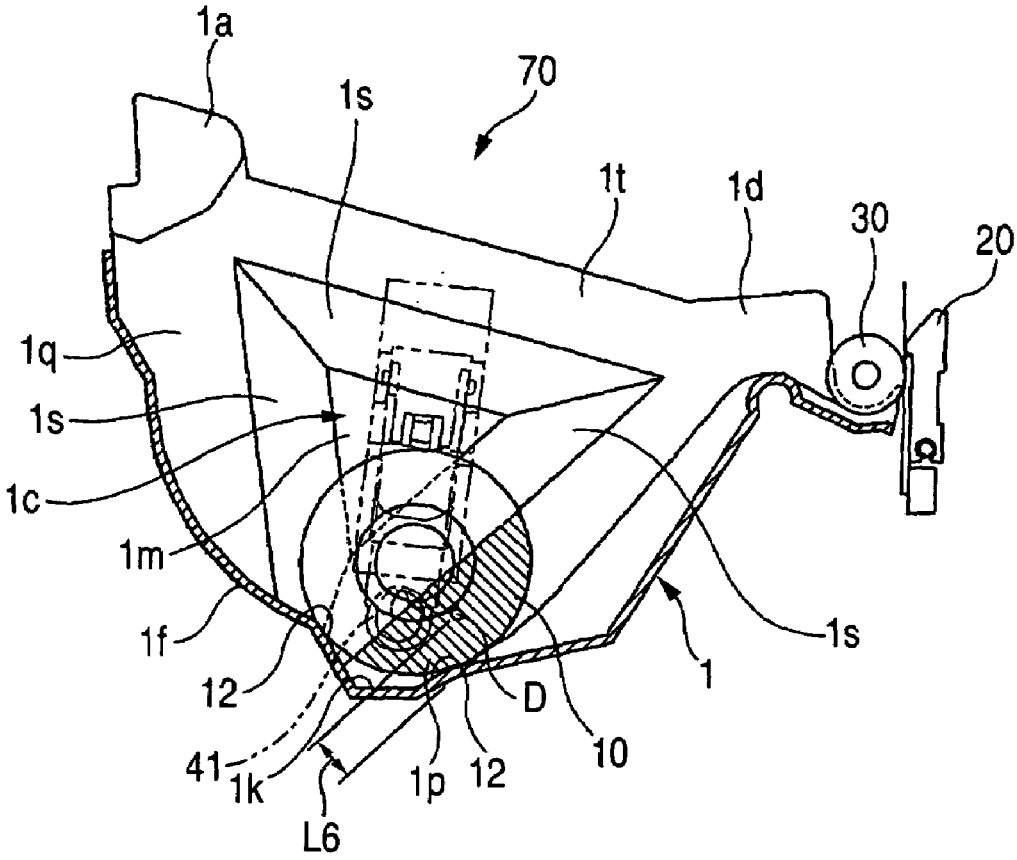
FIG. 4 is a section view taken along the line III—III in FIG. 1, showing a state that the remaining amount of the rolled paper is small.
Figure 5:
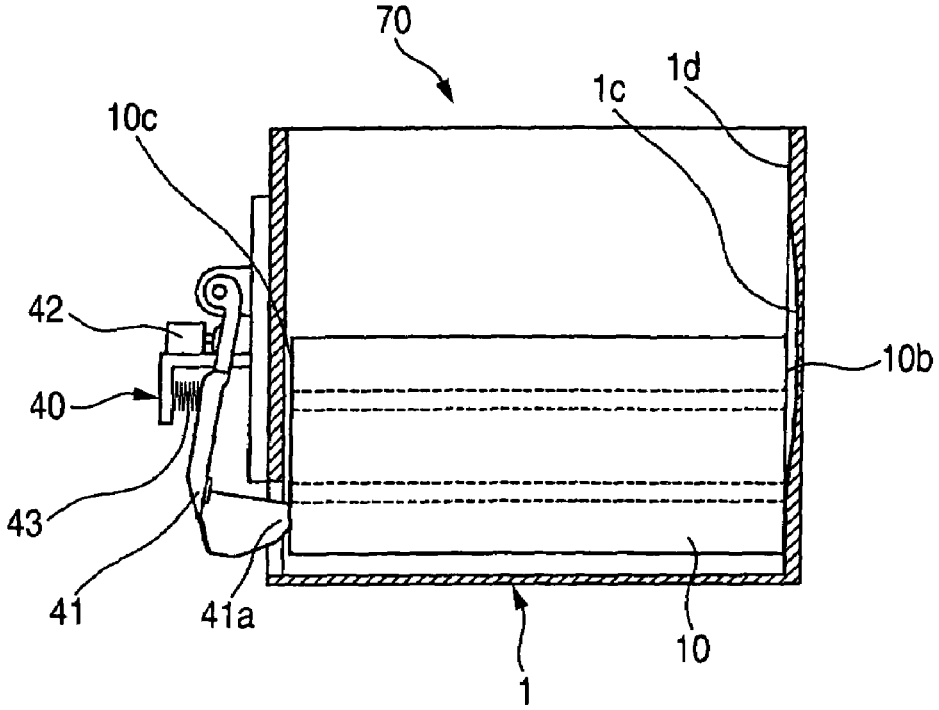
FIG. 5 is a section view taken along a line V—V in FIG. 1.

More specifically, when the diameter of the rolled paper 10 is relatively large as shown in FIGS. 1 and 3, the side end face 10*b* of the rolled paper 10 is supported by a guiding portion 1*t* and the guiding portion 1*p*. On the other hand, when the diameter of the rolled paper 10 is relatively small as shown in FIGS. 4 and 5, the side end face 10*b* is supported by only the guiding portion 1*p*. That is, the guiding portion 1*p* is always opposed to a portion of the rolled paper 10 where the paper 11 is drawn out with the rolled paper held by edges 12 of the recess 1*k* as shown in FIGS. 3 and 4. To establish this positional relationship, the recess 1*c* is situated closer to the rear end of the rolled paper holder 1 relative to the recess 1*k* as shown in FIG. 2.

Figure 12:
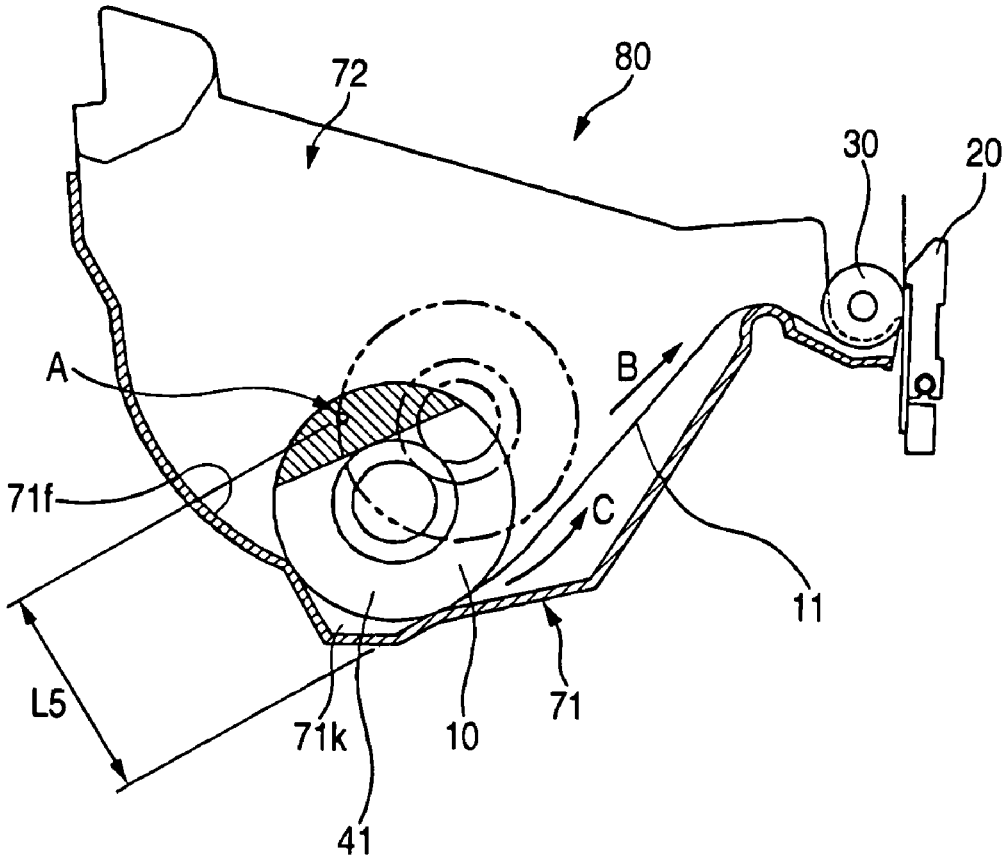
FIG. 12 RELATED ART
FIG. 12 is a section view for explaining a problematic condition occurred in the printer of FIG. 8.
Figure 13:
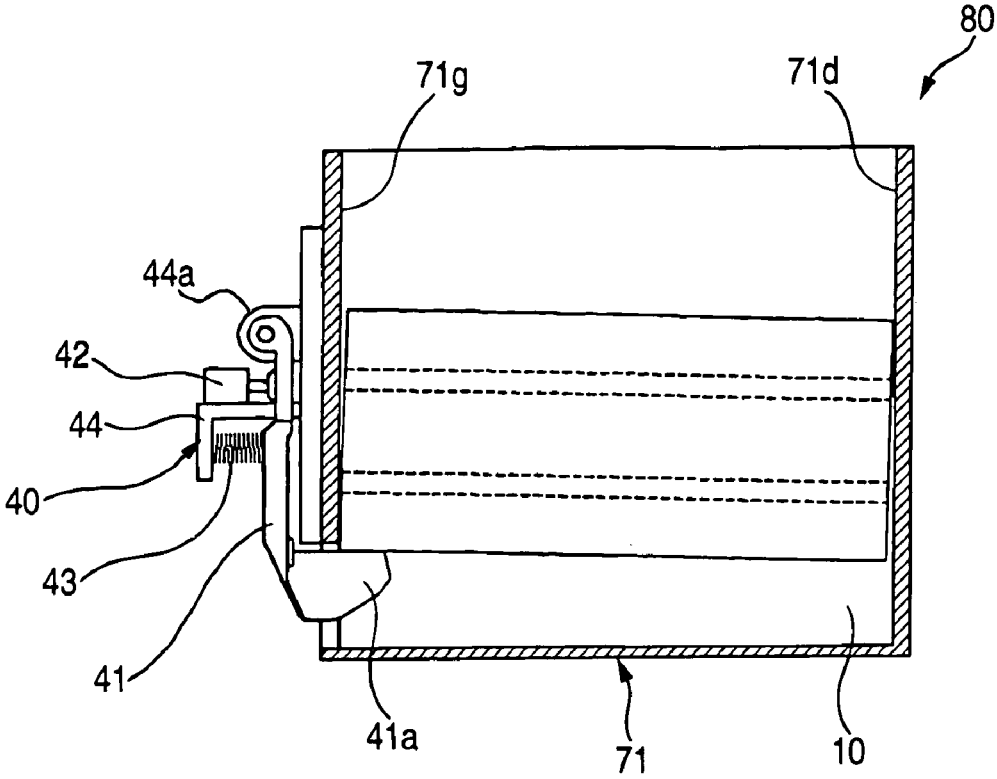
FIG. 13 RELATED ART
FIG. 13 is a section view for explaining a problematic condition occurred in the printer of FIG. 8.
Figure 14:
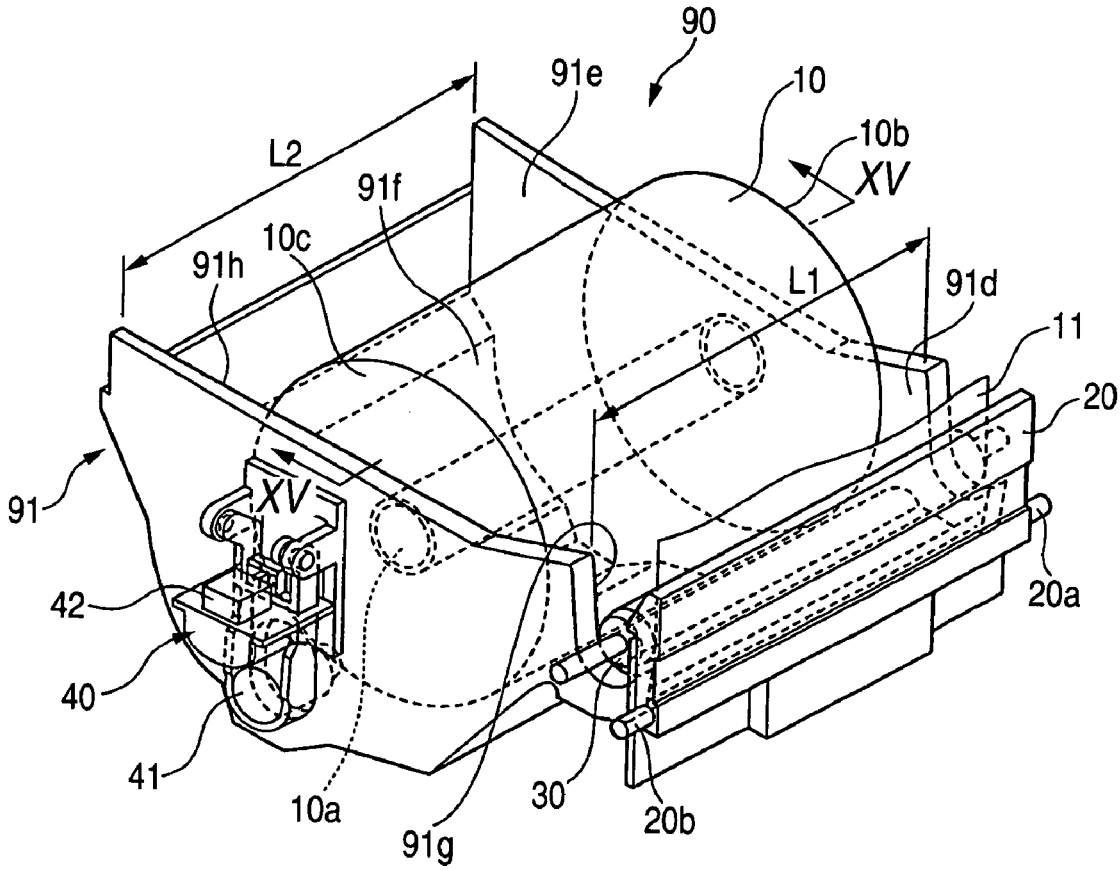
FIG. 14 is a perspective view of a portion of a second related-art printer.
Figure 15:
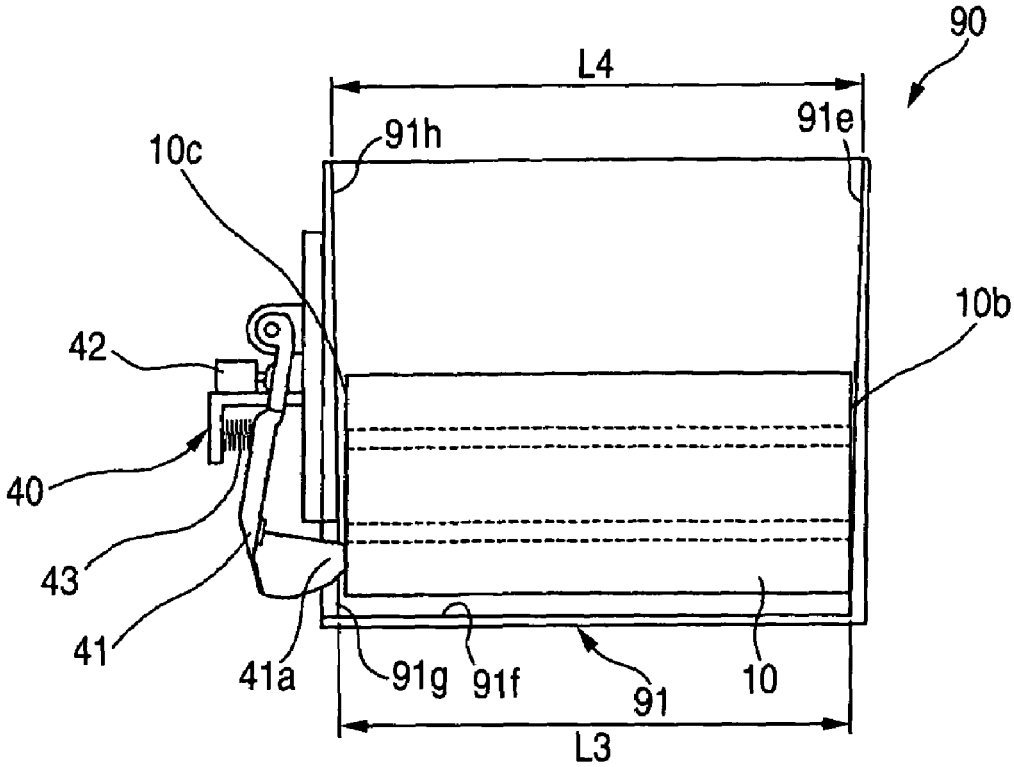
FIG. 15 is a section view taken along a line XV—XV in FIG. 14.
Figure 16:
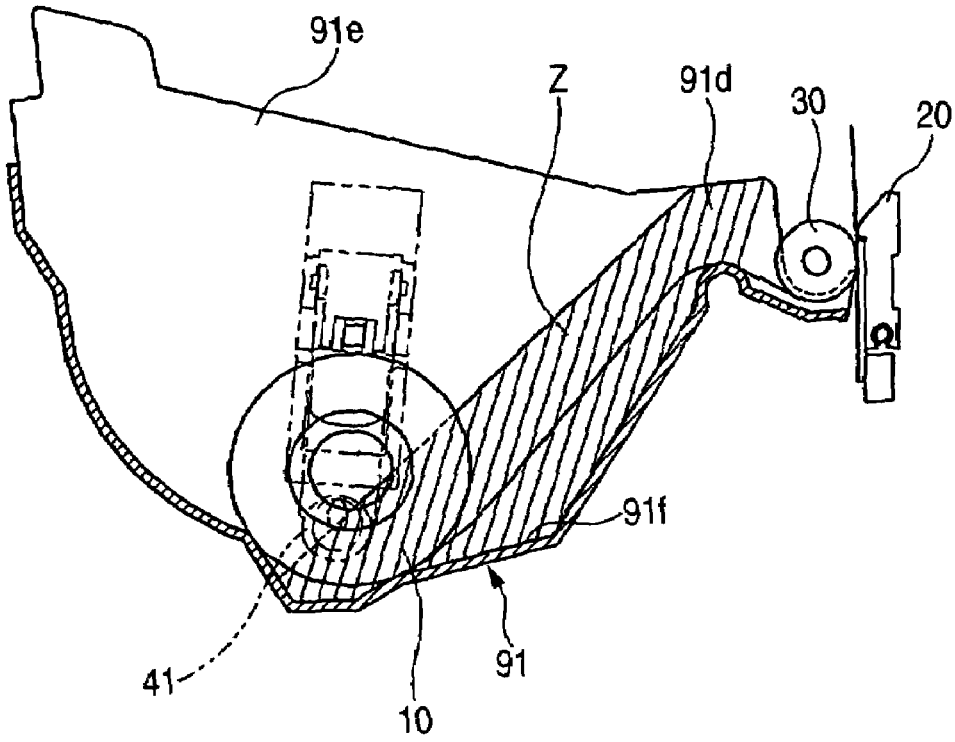
FIG. 16 is a section view for explaining a problematic condition occurred in the printer of FIG. 14.

Therefore, when the diameter of the rolled paper 10 becomes small, the upper part of the rolled paper 10 (the hatched section A in FIG. 12) is completely free from contact with the right guide face 1*d*. The contact between the rolled paper 10 and the right guide face is rather established only at the hatched section D in FIG. 4. As a result, a distance L6 between a portion to be an undesired rotation center of the rolled paper 10 (the substantially center portion of the hatched section D) and the drawn-out portion of the paper 11 is sufficiently smaller than the distance L5 shown in FIG. 12. In comparison with the related-art printers, a moment lifting the roller paper 10 becomes considerably small with regard to the weight of the rolled paper 10. Accordingly, the lifting phenomenon can be prevented even if the diameter (weight) of the rolled paper 10 becomes small.

Figure 6:
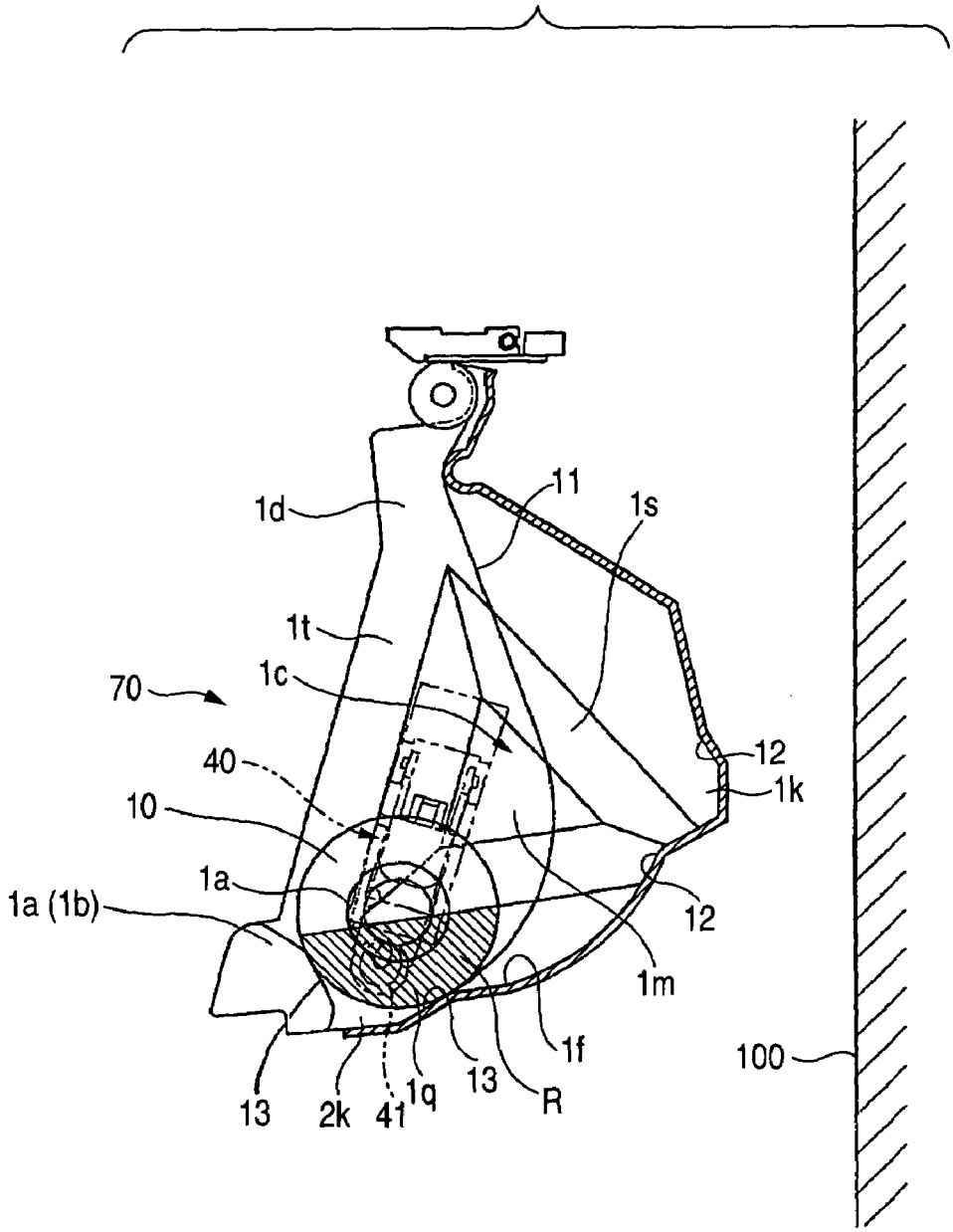
FIG. 6 is a section view taken along the line III—III in FIG. 1, showing a state that the printer is vertically installed.

In a case where the printer 70 is installed so as to lie along a vertical wall face 100 as shown in FIG. 6, the rolled paper 10 is supported by holding edges 13 of supporting projections 1*a*, 1*b* provided on the rear side of the rolled paper holder 1 and the curved portion of the bottom face 1*f*. In other words, in the state of the printer installed as shown in FIG. 6, a recess 2*k* is formed between the holding edges 13.

It is also necessary to dispose the near-end detector 40 (shown by a phantom line in FIG. 6) corresponding to the recess 2*k*. Therefore, the mounting angle is about 90 degrees different from the case shown in FIG. 4, and the mounting direction and position are determined corresponding to the level of the core hole 10*a* when the rolled paper 10 is consumed to a predetermined amount.

In this case, when the diameter of the rolled paper 10 is relatively large, the side end face 10*b* of the rolled paper 10 is supported by a guiding portion 1*t* and a guiding portion 1*q*. On the other hand, when the diameter of the rolled paper 10 is relatively small as shown in FIG. 6, the side end face 10*b* is supported by only the guiding portion 1*q*. That is, the guiding portion 1*q* is always opposed to a portion of the rolled paper 10 where the paper 11 is drawn out in a state that the rolled paper is held by edges 13 of the recess 2*k*.

As in the case where the printer 70 is horizontally installed as shown in FIG. 4, the moment lifting the rolled paper 10 is suppressed, so that the paper 11 can be fed smoothly.

In this embodiment, the position of the recess 1*c* is so determined that an upper end of the side end face 10*b* of the rolled paper 10 opposes an upper end of the recess 1*c* when the diameter of the rolled paper 10 becomes two thirds of the initial diameter thereof when the printer 70 is horizontally placed as shown in FIG. 4. It should be noted that the rolled paper 10 which is relatively small in width is lighter than the rolled paper 10 having the larger width even when the outer diameter is the same. In addition, the width supported by the bottom face 1*f* is relatively smaller than the outer diameter of the rolled paper 10. In such a case, the entire rolled paper 10 tends to be inclined in the widthwise direction thereof, so that the lifting phenomenon due to generation of the moment tends to occur. In view of the above, it is preferable to determine the position and shape of the recess 1*c* taking due account of the width and the weight of the rolled paper 10 relative to the outer diameter thereof, the pressing force of the contact 41 of the near-end detector 40, and the friction coefficient of the portion which comes in contact with the end face 10*b* of the rolled paper 10, which is determined by the material of the rolled paper holder 1.

Generally, in order to stabilize the movement of the contact 41 when detection is made by the near-end detector 40, it is necessary to allow the contact 41 to come into contact with the end face 10*c* of the rolled paper 10 by at least a certain pressing force. In this embodiment, since the rolled paper 10 can be held in a stable manner even when a force is exerted from the end face 10*c*, the spring load of the near-end detector 40 can be increased, and hence the design flexibility of the near-end detector 40 is advantageously improved.

Next, a printer 170 according to a second embodiment of the invention will be described with reference to FIGS. 7 and 8. In these figures, the thermal recording head 20 and the platen roller 30 are omitted. The members similar to those in the first embodiment will be designated by the same reference numerals, and the repetitive explanation for those will be omitted.

In this embodiment, a rolled paper holder 91 includes a right guide face 91*d* fixed with respect to the bottom face 1*f* for guiding the end face 10*b* of the rolled paper 10, and a holding face 50*a* which is a movable guide face for pressing the rolled paper 10 toward the right guide face 91*d* with resilient forces generated by springs 51.

Figure 7:
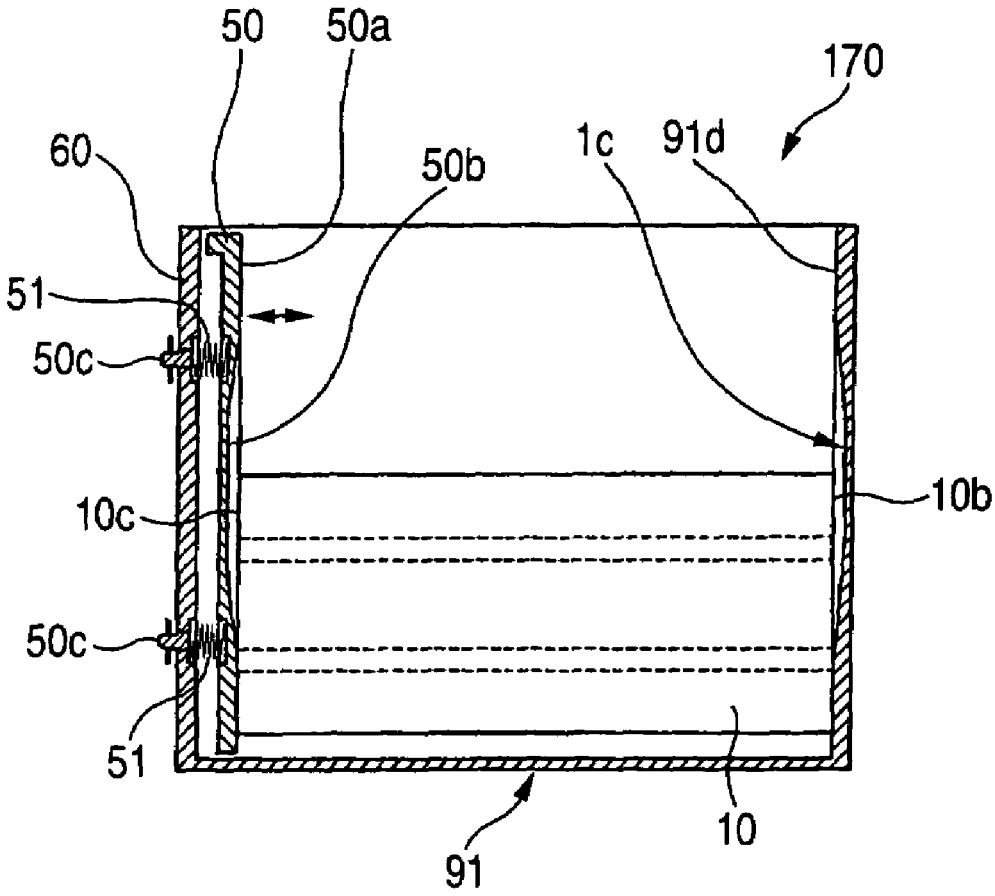
FIG. 7 is a section view of a portion of a printer according to a second embodiment of the invention.
Figure 8:
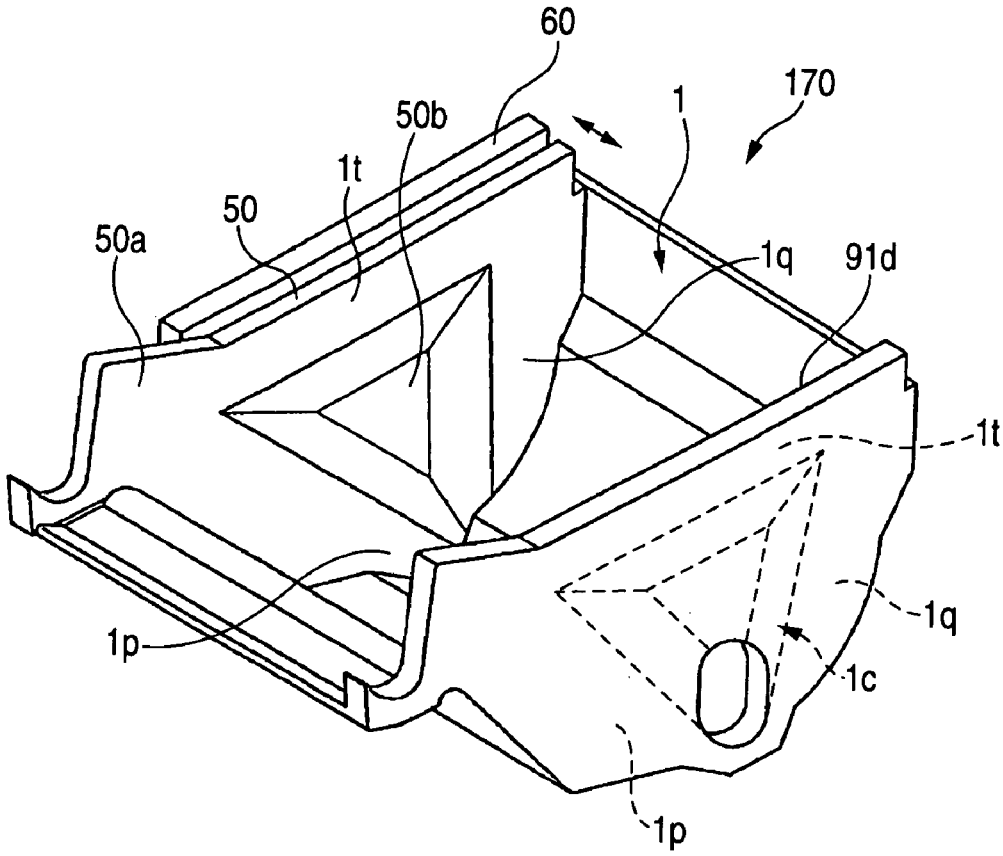
FIG. 8 is a perspective view of a rolled paper holder in the printer of FIG. 7.
Figure 9:
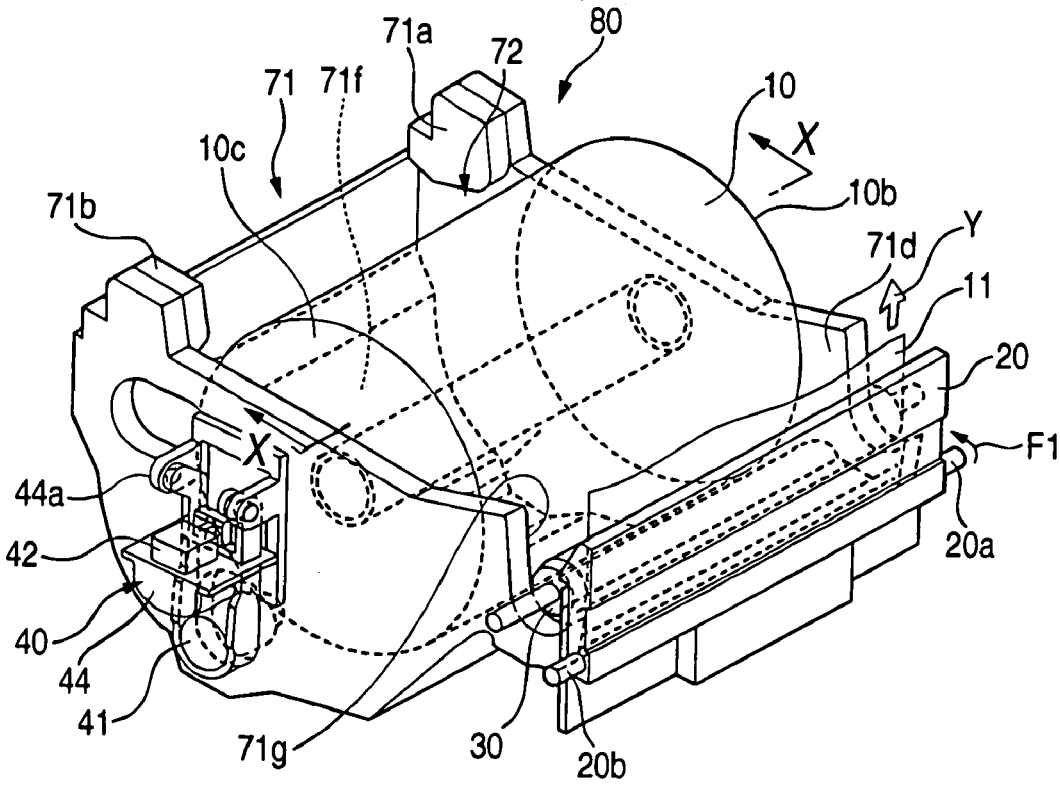
FIG. 9 RELATED ART
FIG. 9 is a perspective view of a portion of a first related-art printer.
Figure 10:
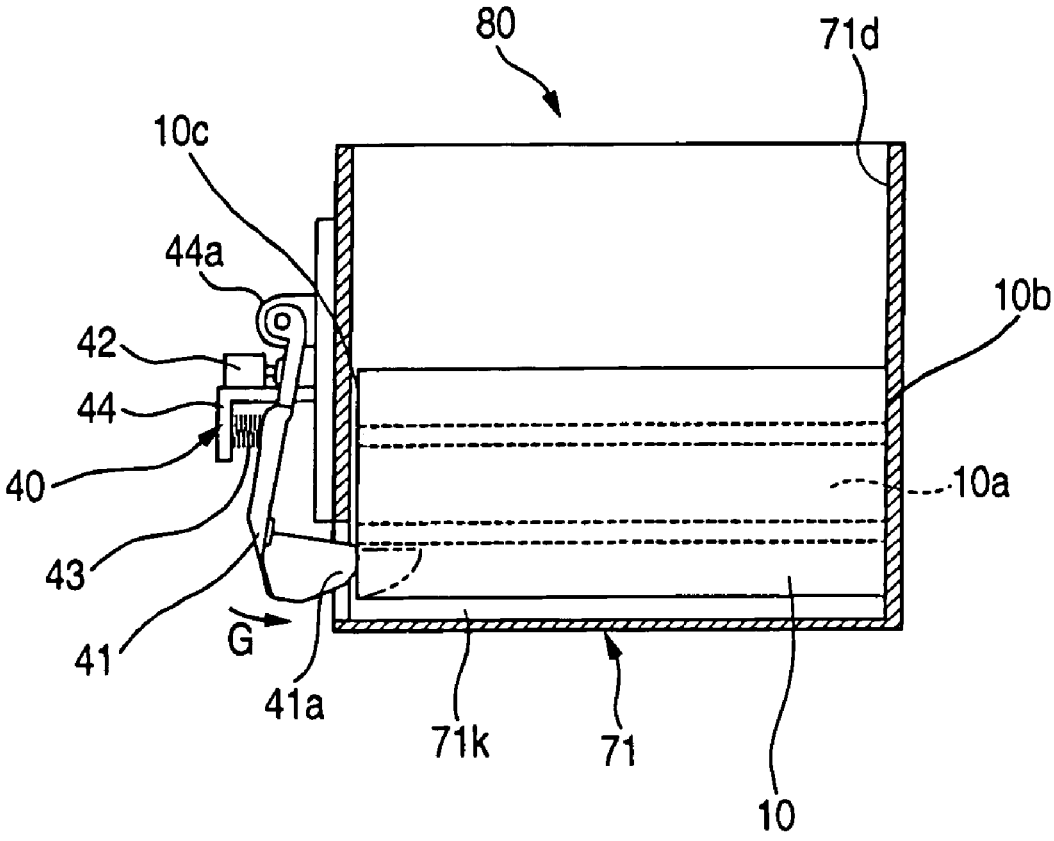
FIG. 10 RELATED ART
FIG. 10 is a section view taken along a line X—X in FIG. 9.
Figure 11:
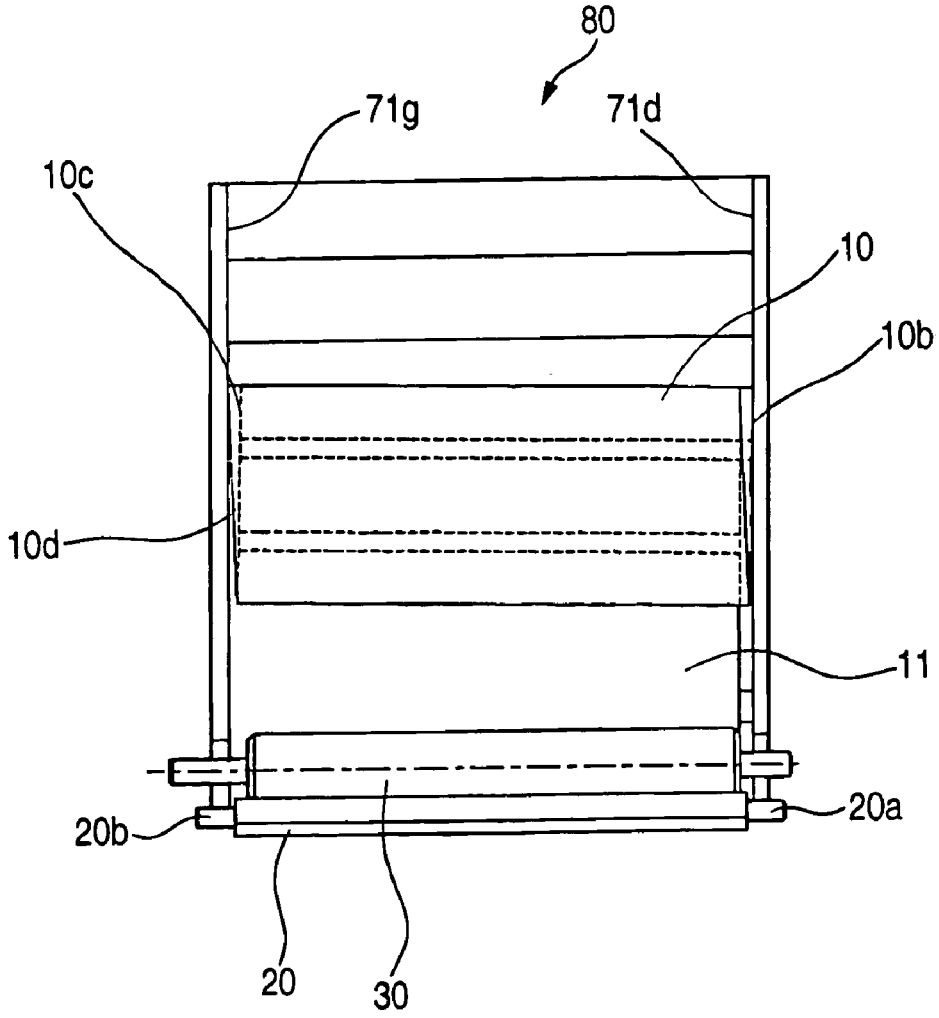
FIG. 11 RELATED ART
FIG. 11 is a plan view for explaining a problematic condition occurred in the printer of FIG. 8.

As shown in FIG. 7, a holding plate 50 having the holding face 50*a* is supported by a plurality of guide shafts 50*c* penetrating a left wall 60 so as to be capable of sliding in the widthwise direction of the rolled paper 10 (the lateral direction in this figure). The springs 51 are provided between the holding plate 50 and the left side wall 60 while being wound around the guide shafts 50*c*. Therefore, the rolled paper 10 is always kept stable at the reference position at which the rolled paper is brought into press contact with the right guide face 91*d*.

In this embodiment, the above-described guiding portions 1*p*, 1*q*, 1*t* are defined by a recess 50*b* formed on the holding plate 50 and the recess 1*c* formed on the right guide face 91*d*. The recess 50*b* is provided so as to oppose to the recess 1*c*.

When the printer 170 is installed horizontally as shown in FIG. 7, when the diameter of the rolled paper 10 is relatively large, the side end face 10*b* of the rolled paper 10 is supported by the guiding portions 1*q*, 1*t* of the right guide face 91*d*, while the side end face 10*c* of the rolled paper 10 is supported by the guiding portions 1*q*, 1*t* of the holding face 50*a*. On the other hand, when the diameter of the rolled paper 10 is relatively small, the side end face 10*b* is supported by only the guiding portion 1*q* of the right guide face 91*d*, while the side end face 10*c* of the rolled paper 10 is supported by only the guiding portion 1*q* of the holding face 50*a*. That is, the guiding portions 1*q* are always opposed to a portion of the rolled paper 10 where the paper 11 is drawn out. Accordingly, also in this embodiment, the moment lifting the rolled paper 10 is reduced, so that the paper 11 can be fed smoothly.

In the first embodiment, although the recess 1*c* defining the guiding portions 1*p*, 1*q*, 1*t* is formed on only the side guide face 1*d* of the rolled paper holder 1, the recess 1*c* may be formed the other side guide face 1*g* as in the second embodiment.

In the above embodiments, although the printer is provided with the mechanical-type near-end detector 40 having the contact 41 to be entered into the core hole 10*a* of the rolled paper 10, the contact 41 may be configured such that the contact 41 urging the side end face 10*b* of the rolled paper 10 proceeds so as to slide on the outer periphery of the rolled paper 10 when the size of the rolled paper 10 is below a predetermined diameter. Alternatively, it may be replaced with an optical-type near-end detector, or may be omitted.

The shape of the recess 1*c* is not limited as configured in the above embodiments. The contour of the recess 1*c* may be arbitrarily determined (e.g., polygonal, circular, oval). The edges connecting the respective peaks of the contour of the recess 1*c* may be curved. Ribs for supporting the side end faces of the rolled paper 10 may be protruded from the side guide faces of the rolled paper holder so as to define a non-contact part corresponding to the above recesses. The recess 1*c* may be a through hole.

In the above embodiments, although two recesses 1*k*, 2*k* for holding the rolled paper 10 are formed on the bottom face 1*f*, additional recesses may be included.

In the above embodiments, the invention is applied to a printer employing a line thermal recording head. The invention may alternatively be applied to an apparatus which employs an impact-dot type recording head or an ink jet recording head, in which the rolled recording medium is loaded by the throw-in system.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A holder for holding a rolled recording medium, the holder comprising:

a pair of side wall members, each of which is opposed to a side end face of the rolled recording medium to regulate a position of the rolled recording medium in a widthwise direction thereof, at least one of the side wall members including a first section adapted to be brought into contact with the side end face, and a second section adapted to avoid contact with the side end face; and a bottom wall member connecting the side wall members and supporting the rolled recording medium regardless of a diameter thereof, wherein a position of the second section is determined such that an upper part of the side end face is free from contact with the at least one of the side wall members, and wherein a position of the first section is determined such that a lower part of the side end face is brought into contact with the first section.

2. The holder as set forth in claim 1, wherein the second section is a recess formed on the at least one of the side wall members.

3. The holder as set forth in claim 1, wherein the bottom wall member is formed with at least one recess for holding the rolled recording medium at a predetermined position.

4. The holder as set forth in claim 1, wherein one of the side wall members is movable in the widthwise direction of the rolled recording medium so as to resiliently press the rolled recording medium against the other of the side wall members.

5. An image forming apparatus, comprising an image forming section, which performs an image forming operation with respect to a recording medium drawn out from the rolled recording medium held in the holder as set forth in claim 1.

6. A holder for holding a rolled recording medium, the holder comprising:

a pair of side wall members, each of which is opposed to a side end face of the rolled recording medium to regulate a position of the rolled recording medium in a widthwise direction thereof, at least one of the side wall members including a first section adapted to be brought into contact with the side end face, and a second section adapted to avoid contact with the side end face, wherein a position of the second section is determined such that an upper part of the side end face is free from contact with the at least one of the side wall members, and wherein a position of the first section is determined such that a lower part of the side end face is brought into contact with the first section; and a bottom wall member connecting the side wall members and formed with a first recess for holding the rolled recording medium at a first predetermined position when the holder is horizontally installed, and a second recess for holding the recording medium at a second predetermined position when the holder is vertically installed.

7. A holder for holding a rolled recording medium, the holder comprising:

a pair of side wall members, each of which is opposed to a side end face of the rolled recording medium to regulate a position of the rolled recording medium in a widthwise direction thereof, at least one of the side wall members including a first section adapted to be brought into contact with the side end face, and a second section adapted to avoid contact with the side end face; and a detector provided on one of the side wall members, the detector comprising a contact member abutted against one of the side end faces of the rolled recording medium such that a contact condition is changed when a diameter of the rolled recording medium becomes a predetermined value or less, wherein the first section and the second section are provided on the other of the side wall members.

8. A recording medium holder for holding a rolled recording medium, the recording medium holder comprising:

a pair of sidewalls sufficiently spaced to receive the rolled recording medium, at least one of the sidewalls including a recessed portion therein defining a non-contact area; and a bottom wall member connecting the side wall members and supporting the rolled recording medium regardless of a diameter thereof, wherein at least one sidewall is structured such that when a size of the rolled recording medium is below a predetermined diameter, a portion of the rolled recording medium is disposed adjacent the recessed non-contact area.

9. The recording medium holder as set forth in claim 8, wherein the bottom wall member is formed with at least one recess for holding the rolled recording medium at a predetermined position.

10. The recording medium holder as set forth in claim 8, wherein one of the side wall members is movable in the widthwise direction of the rolled recording medium so as to resiliently press the rolled recording medium against the other of the side wall members.

11. A recording medium holder for holding a rolled recording medium, the recording medium holder comprising a pair of sidewalls sufficiently spaced to receive the rolled recording medium, at least one of the sidewalls including a recessed portion therein defining a non-contact area, wherein at least one sidewall is structured such that when a size of the rolled recording medium is below a predetermined diameter, a portion of the rolled recording medium is disposed adjacent the recessed non-contact area, the recording medium holder further comprising a bottom wall member connecting the side wall members and formed with a first recess for holding the rolled recording medium at a first predetermined position when the holder is horizontally installed, and a second recess for holding the recording medium at a second predetermined position when the holder is vertically installed.

12. A recording medium holder for holding a rolled recording medium, the recording medium holder comprising:

a pair of sidewalls sufficiently spaced to receive the rolled recording medium, at least one of the sidewalls including a recessed portion therein defining a non-contact area; and a detector provided on one of the side wall members, the detector comprising a contact member abutted against a side face of the rolled recording medium, wherein a contact condition is changed when the size of the rolled recording medium is the predetermined diameter, wherein at least one sidewall is structured such that when a size of the rolled recording medium is below a predetermined diameter, a portion of the rolled recording medium is disposed adjacent the recessed non-contact area.

13. A paper holder for holding a paper roll, the paper holder comprising:

a bottom wall member shaped to support the paper roll regardless of a diameter thereof; and a pair of sidewalls extending upward from the bottom wall member, the sidewalls being sufficiently spaced to receive the paper roll, wherein at least one of the sidewalls comprises means for avoiding contact with a side end face of the paper roll regardless of an orientation of the paper holder and depending on a size of the paper roll.

14. A printer comprising:

a print head;

a platen roller disposed adjacent the print head; and a paper holder for holding a paper roll, the paper holder including:

a bottom wall member shaped to support the paper roll regardless of a diameter thereof, and a pair of sidewalls extending upward from the bottom wall member, the sidewalls being sufficiently spaced to receive the paper roll, wherein at least one of the sidewalls comprises means for avoiding contact with a side end face of the paper roll regardless of an orientation of the printer and depending on a size of the paper roll, wherein paper is delivered to the print head and platen roller from the paper holder.

* * * * *